US008597746B2

(12) United States Patent
Berbert

(10) Patent No.: US 8,597,746 B2
(45) Date of Patent: Dec. 3, 2013

(54) PEELABLE VACUUM SKIN PACKAGES

(75) Inventor: Otacilio T. Berbert, Oshkosh, WI (US)

(73) Assignee: Curwood, Inc., Oshkosh, WI (US)

( * ) Notice: Subject to any disclaimer, the term of this patent is extended or adjusted under 35 U.S.C. 154(b) by 905 days.

(21) Appl. No.: 11/141,144

(22) Filed: May 31, 2005

(65) Prior Publication Data

US 2006/0269707 A1 Nov. 30, 2006

(51) Int. Cl.

| | |
|---|---|
| ***B32B 1/08*** | (2006.01) |
| ***B32B 27/32*** | (2006.01) |
| ***B32B 27/36*** | (2006.01) |

(52) U.S. Cl.

USPC ..... 428/35.7; 428/36.6; 428/36.7

(58) Field of Classification Search

USPC ..... 428/35.7, 36.6, 36.7, 515

See application file for complete search history.

(56) References Cited

U.S. PATENT DOCUMENTS

| | | | | |
|---|---|---|---|---|
| 4,120,716 | A | 10/1978 | Bonet | |
| RE30,009 | E | 5/1979 | Perdue et al. | |
| 4,367,312 | A * | 1/1983 | Bontinck et al. | 525/93 |
| 4,382,513 | A | 5/1983 | Schirmer et al. | |
| 4,605,460 | A | 8/1986 | Schirmer | |
| 4,611,456 | A | 9/1986 | Gillio-tos et al. | |
| 4,680,340 | A | 7/1987 | Oreglia et al. | |
| 4,756,421 | A * | 7/1988 | Meek | 206/524.2 |
| 4,810,541 | A | 3/1989 | Newman et al. | |
| 4,859,514 | A | 8/1989 | Friedrich et al. | |
| 4,886,690 | A | 12/1989 | Davis et al. | |
| 4,927,691 | A | 5/1990 | Bekele | |
| 4,956,212 | A * | 9/1990 | Bekele | 428/36.6 |
| 4,963,419 | A * | 10/1990 | Lustig et al. | 428/36.7 |
| 5,180,599 | A | 1/1993 | Feldmeier et al. | |
| 5,302,402 | A | 4/1994 | Dudenhoeffer et al. | |
| 5,346,735 | A | 9/1994 | Logan et al. | |
| 5,407,611 | A | 4/1995 | Wilhoit et al. | |
| 5,846,582 | A | 12/1998 | Mayfield et al. | |
| 5,919,547 | A | 7/1999 | Kocher et al. | |
| H001816 | H | 11/1999 | Barbowicz | |
| 6,032,800 | A | 3/2000 | Kocher | |
| 6,042,913 | A | 3/2000 | Miranda et al. | |
| 6,044,622 | A | 4/2000 | Brady et al. | |

(Continued)

FOREIGN PATENT DOCUMENTS

| | | |
|---|---|---|
| EP | 686497 A2 | 12/1995 |
| EP | 1020366 A1 | 7/2000 |
| WO | WO 02/062575 A2 | 8/2002 |

OTHER PUBLICATIONS

Product Bulletin "VSP Film Project X101-2773-EB"—Curwood, Inc., Aug. 2004.

(Continued)

*Primary Examiner* — Erik Kashnikow

(74) *Attorney, Agent, or Firm* — Tom J. Hall

(57) ABSTRACT

The present invention describes vacuum skin packages comprising a thermoplastic film and a polyester substrate wherein the thermoplastic film includes at least a first polymer layer having a first surface and an opposing second surface and comprises an ethylene/unsaturated ester copolymer, wherein the first surface has been surface treated in a manner to exhibit a surface tension of between 36-60 dynes/cm. The thermoplastic film is adapted to form a peelable seal between the first surface of the first polymer layer of the thermoplastic film and the polyester substrate by a pressure of less than $1\times10^5$ Pa applied therebetween, wherein the peelable seal has a seal strength of between 0.5-6 lb./in. (0.09-1.08 kg/cm).

37 Claims, 3 Drawing Sheets

(56) References Cited

U.S. PATENT DOCUMENTS

| | | | | |
|---|---|---|---|---|
| RE37,171 | E | 5/2001 | Busche et al. | |
| 6,630,237 | B2 | 10/2003 | Rivett et al. | |
| 7,166,342 | B2 | 1/2007 | Hayakawa et al. | |
| 2002/0172834 | A1 * | 11/2002 | Rivett et al. | 428/515 |
| 2003/0129434 | A1 | 7/2003 | Glawe et al. | |
| 2003/0152669 | A1 | 8/2003 | Vadhar et al. | |
| 2004/0151932 | A1 | 8/2004 | Galloway | |
| 2004/0197442 | A1 | 10/2004 | Della Bianca et al. | |
| 2005/0042468 | A1 | 2/2005 | Peiffer et al. | |

OTHER PUBLICATIONS

Product Bulletin "VSP Film Project X101-2861-EB"—Curwood, Inc., Aug. 2004.

Product Bulletin "VSP Film Project X101-2957-EB"—Curwood, Inc., Aug. 2004.

* cited by examiner

PEELABLE VACUUM SKIN PACKAGES

FIELD OF THE INVENTION

The present invention generally relates to vacuum skin packages, and particularly, to easily-opened vacuum skin packages applications and the like.

BACKGROUND OF THE INVENTION

Vacuum skin packaging is a process in wide commercial use today which involves placing a perishable food inside a plastic film package and then, removing air from inside the package so that the packaging material remains in close contact with the product surfaces after sealing. Vacuum skin packaging is useful for packaging food and non-food items, and especially desirable in packaging of fresh or frozen meats, such as beef, chicken, pork, and fish. The vacuum skin packaging process itself is now well known in the art. Various vacuum skin packaging processes are disclosed in, e.g., U.S. Pat. No. RE30,009 to Perdue et al.; U.S. Pat. No. 4,055,672 to Hirsch et al.; U.S. Pat. No. 4,375,851 to Paulos; U.S. Pat. No. 5,033,253 to Havens et al.; and U.S. Pat. No. 5,460,269 to Bayer, which are each incorporated herein by reference in their entireties. For example, U.S. Pat. No. RE30,009 to Perdue et al. describe several methods by which a vacuum skin package may be constructed by use of a vacuum chamber. Exemplary of these methods is a process which includes placing an article onto a thermoplastic bottom web or support substrate in a vacuum chamber and then, shaping the top web into a concavity by differential air pressure. While maintaining the concave shape by differential air pressure, the top web is heated to its softening and forming temperature while positioning the web over the article and bottom substrate. A vacuum is drawn in the chamber in a manner such that a vacuum exists between the top web and a bottom support substrate. At this point, the top web is moved to contact the article and the bottom substrate. The top web is thus sealed against the bottom substrate. Typically, the top web becomes a skin on the article and bottom substrate in the finished package, making the finished package difficult to open by the consumer or end user. Consequently, when it is desired to remove the product, a knife or other sharp implements must be used to puncture the packaging film.

Also, well known in the art are easy-open packages and packaging materials in their construction. Reference may be made, for example, to U.S. Pat. No. RE37,171 to Busche et al. which describe an easy open package to be heat-seal closed and peelably reopened. The patent discloses an interior film layer of an adhesive (or tie layers) which may be peelably bonded to either an adjacent exterior film layer or an adjacent interior film layer. Peelability may be provided by adhesive (or tie layers) compositions which include polybutylene in combination with a polyethylene or ethylene/vinyl acetate copolymer.

U.S. Patent Application No. 2005/0042468 to Peiffer et al. disclose a coextruded, biaxially oriented polyester film suitable for use as a lid with trays made of polyester. These films comprise a base layer and a heat-sealable, peelable top layer. The peelable top sealant layer includes a mixture of at least two polymeric-component resins: a polyester and a polyester-incompatible polymer.

U.S. Pat. No. 6,630,237 to Rivett et al. also disclose peelable heat-seal films useful for easy-open packaging applications. The peelable layer of these films includes a blend of polybutylene, ionomer and an ethylene/unsaturated ester copolymer. The patent further discloses a peelable package formed from these films and require that the peelable layer be heat-sealed to itself or a similar film composition in order to provide peelable packages.

U.S. Pat. No. 5,346,735 to Logan et al. describe a film structure useful for vacuum skin packaging comprising a two-ply structure which comprises both an oxygen-impermeable film and an oxygen-permeable film. The two films delaminate at their interface rather than between a support substrate and one of either film. The peelable interface is formed by bonding a layer comprising ethylene/vinyl alcohol copolymer or polyamide of the impermeable film to an adjacent layer comprising ethylene/alpha olefin copolymer of the permeable film.

U.S. Pat. No. 4,859,514 to Friedrich et al. disclose thermoplastic films for easily opened packages which include a first film having a first sealant layer and a second film having a second sealant layer wherein the two sealant layers are heat-sealed together. The first sealant layer may comprise either ionomer or a blend of an ionomer and ethylene/vinyl acetate copolymer, and the second sealant layer may include a blend of ethylene/vinyl acetate copolymer, ethylene/butene copolymer and polypropylene. The first film may separate from the second film at the interface between the two sealant layers.

Notwithstanding the aforementioned advances in the packaging industry, there still remains a need in the art for improved vacuum skin packages which provide the benefits of peelability.

SUMMARY OF THE INVENTION

The present invention resulted from the discovery that vacuum skin packages formed from thermoplastic films and a polyester substrate may be adapted to form a peelable seal between the exterior film layer of the thermoplastic film and the polyester substrate under a vacuum. That is, peelable vacuum skin packages may be formed from thermoplastic films which have a surface-treatment to the exterior surface of these film structures which may control the seal strength between the film and then polyester substrate. Applicants have discovered that when an exterior film surface has a surface energy as determined by a surface tension of between 36-60 dynes/cm, the seal which forms between the exterior surface and the polyester substrate under a vacuum has a seal strength of between 0.5-6 lb./in. (0.09-1.08 kg/cm), thereby providing a peelable vacuum skin package.

As a first aspect, the present invention pertains to vacuum skin packages formed from a thermoplastic film and a polyester substrate such that the thermoplastic film has a film structure comprising of at least a first polymer layer that includes an ethylene/unsaturated ester copolymer, wherein the first layer is an exterior film layer which is free of both polybutylene and an ionomer resin. The ethylene/unsaturated ester copolymer may comprise any ethylene/unsaturated ester copolymer or derivative thereof, preferably a material selected from the group consisting of ethylene/methyl acrylate copolymer, ethylene/methyl methacrylate copolymer, ethylene/ethyl acrylate copolymer, ethylene/ethyl methacrylate copolymer, ethylene/butyl acrylate copolymer, ethylene/2-ethylhexyl methacrylate copolymer, ethylene/vinyl acetate copolymer, and blends thereof, and more preferably an ethylene/vinyl acetate copolymer or blends thereof. The first polymer layer includes a first surface and an opposing second surface wherein the first surface has a surface tension of between 36-60 dynes/cm, preferably 40-56 dynes/cm as measured in accordance with ASTM D-2578-84 Test Method, which is incorporated herein by reference in its entirety. The polyester substrate may comprise any polyester, preferably a material selected from the group consisting of polyethylene terephthalate (PET), crystalline polyethylene terephthalate (CPET), amorphous polyethylene terephthalate (APET), and blends thereof. The thermoplastic film is adapted to form a peelable seal between the first surface of the first layer and the polyester substrate by pressure of less than $1\times10^5$ Pa applied therebetween. The peelable seal may exhibit a seal strength of between 0.5-6 lb./in. (0.09-1.08 kg/cm) as measured in accordance with ASTM F-904 Test Method, which is incorporated herein by reference in its entirety.

In another aspect, the subject invention relates to vacuum skin packages comprising a thermoplastic film and a polyester substrate such that the thermoplastic film comprises a film structure that includes the above-mentioned first polymer layer and four additional polymeric film layers. Accordingly, the thermoplastic films may comprise a first polymer layer, a second polymer layer, a third polymer layer, a fourth polymer layer and a fifth polymer layer. The second polymer layer may comprise any ionomer resin or a blend thereof and may be adhering to the first polymer layer as an interior film layer. The third polymer layer may comprise a material selected from the group consisting of polyolefin resin, ionomer resin, oxygen barrier material or a blend thereof. The third polymer layer may also be an interior film layer. The fourth polymer layer may comprise a material selected from the group consisting of a polyolefin resin, ionomer resin or a blend thereof. The third polymer layer may also be an interior film layer. The fifth polymer layer may comprise a polyolefin resin or a blend thereof, and may function as an exterior film layer.

In still another aspect, the present invention is directed to vacuum skin packages comprising a thermoplastic film and a polyester substrate such that the thermoplastic film has a film structure that includes seven polymer layers. That is, the thermoplastic film structures may comprise a first polymer layer, a second polymer layer, a third polymer layer, a fourth polymer layer, a fifth polymer layer, a sixth polymer layer and a seventh polymer layer. Accordingly, the first polymer layer may be identical to the second polymer layer described hereinabove, and may comprise an ionomer resin or a blend thereof and be in direct contact with both the first polymer layer and the third polymer layer. The third polymer layer may comprise any adhesive material and may be adhere to both the second and fourth polymeric layers. The fourth polymer layer may comprise either a material selected from the group consisting of polyolefin resin, ionomer resin, or a blend thereof, or an oxygen barrier material. The oxygen barrier material may comprise any material which provides the film with an oxygen transmission rate of between 0-2.0 cc/100 in.$^2$/24 hours at 23° C. and 0% R.H. as measured in accordance with ASTM D-3985-02 Test Method, which is incorporated herein by reference in its entirety. Preferably the oxygen barrier material may comprise a material is selected from the group consisting of homopolymers or copolymers of ethylene/vinyl alcohol, vinylidene chloride copolymers, and blends thereof, and more preferably an ethylene/vinyl alcohol copolymer or a blend thereof. The fourth polymer layer may also be an interior film layer. The fifth polymer layer may comprise any adhesive material and may adhere to both the fourth polymer layer and the sixth polymer layer. The sixth polymer layer may comprise a material selected from the group consisting of polyolefin resin, ionomer resin, or blends thereof. The seventh polymer layer may comprise any polyolefin resin or blend thereof and may be an exterior film layer.

In yet still another aspect, the present invention is directed to vacuum skin packaging kits comprising at least a thermoplastic film and a polyester substrate such that the thermoplastic film has a film structure that includes seven polymer layers. That is, the thermoplastic film of these kits include a film structure comprising a first polymer layer, a second polymer layer, a third polymer layer, a fourth polymer layer, a fifth polymer layer, a sixth polymer layer and a seventh polymer layer. Accordingly, the seven polymer layers and the polyester substrate may be identical to the seven polymer layers and polyester substrate described hereinabove.

The vacuum skin packages may include thermoplastic films formed by any coextrusion technique or combination thereof, preferably by either cast or blown film coextrusion.

The vacuum skin packages may include thermoplastic films having an unrestrained linear thermal shrinkage in both the machine and transverse directions of less than 20%, preferably less than 15%, as measured according to ASTM D-2732 Test Method, which is incorporated herein by reference in its entirety.

The vacuum skin packages may include thermoplastic film structures which may be cross-linked by any chemical or low or high radiation method or combination thereof, to a level such that at least one polymeric film layer may comprise a gel content of not less than 10%, preferably not less than 5%, as measured in accordance with ASTM D-2765-01 Test Method, which is incorporated herein by reference in its entirety.

The vacuum skin packages may include thermoplastic films that have any individual film layer thickness and any total film thickness desired, and typically either film layer and/or total film thicknesses may range between 1-10 mils, preferably 2-6 mils, and more preferably 3-5 mils.

BRIEF DESCRIPTION OF THE DRAWINGS

In the drawings which are attached hereto and made a part of this disclosure.

DETAILED DESCRIPTION OF THE INVENTION

Figure 1:
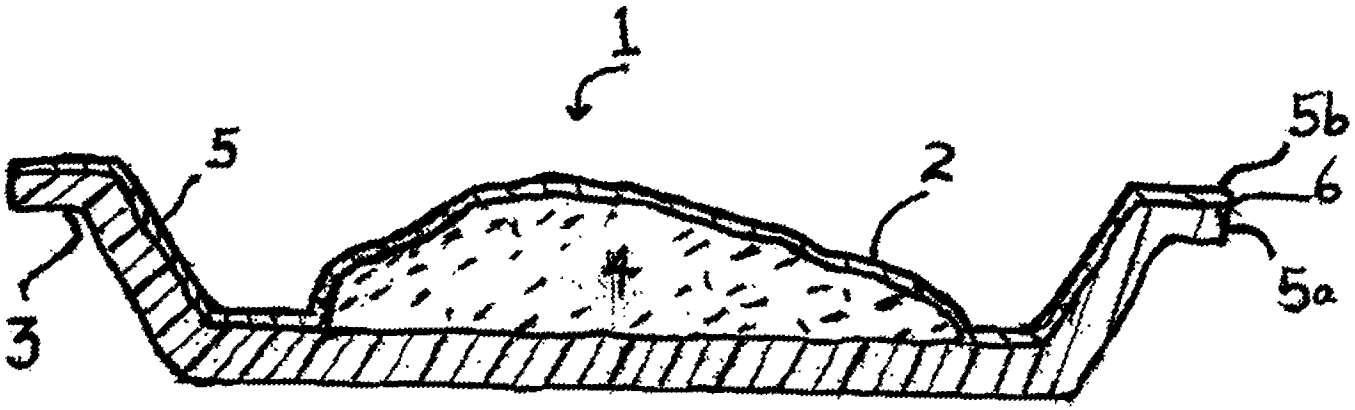
FIG. 1 is a perspective view of one embodiment of a vacuum skin package according to the present invention formed by a thermoplastic film having at least a first polymer layer sealed to a polyester substrate.

As used herein, the term "film" is used in the generic form to include a plastic web, regardless of whether it is a film or sheet.

As used herein, the phrase "thermoplastic" refers to a polymer or polymer mixture that softens when exposed to heat and then returns to its original condition when cooled to room temperature. In general, thermoplastic materials include, but are not limited to, synthetic polymers such as polyolefins, polyesters, polyamides, polystyrenes, and the like. Thermoplastic materials may also include any synthetic polymer that is cross-linked by either radiation or chemical reaction during the manufacturing or post manufacturing process operation.

As used herein, the term "monomer" refers to a relatively simple compound, usually containing carbon and of a low molecular weight, which can react to form a polymer by combining with itself or with other similar molecules or compounds.

As used herein, the term "comonomer" refers to a monomer which is copolymerized with at least one different monomer in a copolymerization reaction, the result of which is a comonomer.

As used herein, the term "polymer" refers to a material which is the product of a polymerization or copolymerization reaction of natural, synthetic, or natural and synthetic monomers and/or comonomers, and is inclusive of homopolymers, copolymers, terpolymers, etc. In general, the layers of a film of the present invention may comprise a single polymer, a mixture of a single polymer and non-polymeric material, a combination of two or more polymer materials blended together, or a mixture of a blend of two or more polymer materials and non-polymeric material.

As used herein, the term "copolymer" refers to polymers formed by the polymerization of reaction of at least two different comonomers. For example, the term "copolymer" includes the copolymerization reaction product of ethylene and a α-olefin, such as 1-hexene. The term "copolymer" is also inclusive of, for example, the co-polymerization of a mixture of ethylene, propylene, 1-butene, 1-hexene, and 1-octene. As used herein, a copolymer identified in terms of a plurality of monomers, e.g., "ethylene/propylene copolymer," refers to a copolymer in which either monomer may copolymerize in a higher weight or molar percent than the other monomer or monomers. It is appreciated by a person of ordinary skill in the art that the term "copolymer," as used herein, refers to those copolymers where the first listed comonomer is polymerized in a higher weight percent than the second listed comonomer.

As used herein, terminology employing a "/" with respect to the chemical identity of any copolymer, e.g., an ethylene/unsaturated ester copolymer, and identifies the comonomers which are copolymerized to produce the copolymer.

As used herein, the phrase "ethylene/unsaturated ester copolymer" refers to copolymers having an ethylene linkage between comonomer units and resulting from the copolymerization of an ethylene comonomer and an unsaturated-ester comonomer. As used herein, the phrase "unsaturated-ester comonomer" refers to comonomer units which may be represented by the following general chemical formulae: (A) $CH_2CROC(O)CH_3$ where R═H or an alkyl group which includes, for example, but is not limited to, methyl, ethyl, propyl, and butyl; (B) $CH_2C(R)C(O)OR'$ where R═H or an alkyl group which includes, for example, but is not limited to, methyl, ethyl, propyl, butyl, 2-ethylhexyl and R' =an alkyl group which includes, but is not limited to, methyl, ethyl, propyl, and butyl. As used herein, the phrase "ethylene comonomer" refers to comonomer units which may be represented by the following general chemical formula: C(R)(R')C(R")(R"') where R, R', R", or R"'═H or an alkyl group. It is recognized by a person of ordinary skill in the art that any atom or chemical moiety represented within parentheses is bonded to the preceding atom and is not bonded to any succeeding atom as presented in the general chemical formulae herein.

As used herein, the term "polyester" refers to homopolymers or copolymers having an ester linkage between monomer units which may be formed, for example, by condensation polymerization reactions between a dicarboxylic acid and glycol. The ester monomer unit may be represented by the general chemical formula: R—C(O)O—R' where R and R'=an alkyl group and may be generally formed from the polymerization of dicarboxylic acid and diol monomers or monomers containing both carboxylic acid and hydroxy moieties. The dicarboxylic acid may be linear or aliphatic, i.e., oxalic acid, malonic acid, succinic acid, glutaric acid, adipic acid, pimelic acid, suberic acid, azelaic acid, sebacic acid, and the like; or may be aromatic or alkyl-substituted aromatic acids, i.e., various isomers of phthalic acid, such as paraphthalic acid (or terephthalic acid), isophthalic acid and naphthalic acid. Specific examples of alkyl-substituted aromatic acids include the various isomers of dimethylphthalic acid, such as dimethylisophthalic acid, dimethylorthophthalic acid, dimethylterephthalic acid, the various isomers of diethylphthalic acid, such as diethylisophthalic acid, diethylorthophthalic acid, the various isomers of dimethylnaphthalic acid, such as 2,6-dimethylnaphthalic acid and 2,5-dimethylnaphthalic acid, and the various isomers of diethylnaphthalic acid. The glycols may be straight-chained or branched. Specific examples include ethylene glycol, propylene glycol, trimethylene glycol, 1,4-butane diol, neopentyl glycol and the like. The polyalkyl terephthalates are aromatic esters having a benzene ring with ester linkages at the 1,4-carbons of the benzene ring as compared to polyalkyl isophthalates, where two ester linkages are present at the 1,3-carbons of the benzene ring. In contrast, polyalkyl naphthalates are aromatic esters having two fused benzene rings where the two ester linkages may be present at the 2,3-carbons or the 1,6-carbons.

As used herein, the phrase "polyolefin" refers to homopolymers, copolymers, including, e.g., bipolymers, terpolymers, block copolymers, grafted copolymers, etc., having a methylene linkage between monomer units which may be formed by any method known to a person of ordinary skill in the art. An example of polyolefin includes polyethylene (PE) which includes, but are not limited to, low-density polyethylene (LDPE), linear low-density polyethylene (LLDPE), very low-density polyethylene (VLDPE), ultra low-density polyethylene (ULDPE), medium-density polyethylene (MDPE), high-density polyethylene (HDPE), ultra high-density polyethylene (UHDPE), and polyethylenes comprising ethylene/α-olefin copolymers (E/AO). These ethylene/α-olefin copolymers are copolymers of ethylene with one or more α-olefins (alpha-olefins) such as butene-1, hexene-1, octene-1, or the like as a comonomer. Other examples of polyolefin include cyclic olefin copolymers (COC), ethylene/propylene copolymers (PEP), polypropylene (PP), propylene/ethylene copolymer (PPE), polyisoprene, polybutylene (PB), polybutene-1, poly-3-methylbutene-1, poly-4-methylpentene-1, ionomers (10), and propylene/α-olefins (P/AO) which are copolymers of propylene with one or more α-olefins (alpha-olefins) such as butene-1, hexene-1, octene-1, or the like as a comonomer.

As used herein, the term "ionomer" refers to an ionic copolymer formed from an olefin and an ethylenically unsaturated monocarboxylic acid having the carboxylic acid moieties partially neutralized by a metal ion. Suitable metal ions may include, but are not limited to, sodium, potassium, lithium cesium, nickel, and preferably zinc. Suitable carboxylic acid comonomers may include, but are not limited to, ethylene/methacrylic acid, methylene succinic acid, maleic anhydride, vinyl acetate/methacrylic acid, methyl/methacrylate/methacrylic acid, styrene/methacrylic acid and combinations thereof. Useful ionomer resins may include an olefinic content of at least 50% (mol.) based upon the copolymer and a carboxylic acid content of between 5-25% (mol.) based upon the copolymer. Useful ionomers are also described in U.S. Pat. No. 3,355,319 to Rees, which is incorporated herein by reference in its entirety.

As used herein, the term "coextrusion" refers to the process of extruding two or more materials through a single die with two or more orifices arranged so that the extrudates merge and weld together into a laminar structure before chilling, i.e., quenching. Coextrusion can be employed in blown film, cast film, and extrusion coating.

As used herein, the phrase "peelable seal" refers to a bond formed between an exterior film layer of a first film and an exterior film layer of a second film (or a substrate) which allows the first film to easily separate or delaminate from the second film. It is desirable that the peelable seal is incorporated into an easy-open package so that the consumer may simply grasp the portion of film having a peelable seal and pull it away thereby causing the peelable seal to "fail." It is also desirable that the peelable seal has sufficient strength to withstand the expected abuse during the packaging operation, distribution, and storage. Accordingly, peelable seals of the present invention may have a seal strength of between 0.5-6 lb./in. (0.09-1.08 kg/cm) as measured in accordance with ASTM F-904 Test Method. As used herein, the phrase "seal strength" refers to the force required to separate or delaminate a first film from an adjacent second film (or a substrate) to which it is adhered to.

As used herein, the phrase "exterior film layer" as applied to film layers of the present invention refers to any film layer having less than two of its principal surfaces directly adhered to another layer of the film. In contrast, the phrase "interior film layer," as applied to film layers, refers to any film layer having both its principal surfaces directly adhered to another layer of the film.

As used herein, the terms "adhere," "adhered" and "adheres," as applied to film layers of the present invention, are defined as adhesion of the subject film layer surface to another film layer surface (presumably, over the entire planar surfaces).

As used herein, the term "vacuum" refers to a pressure below atmospheric pressure and is expressed with respect to zero pressure (or absolute mode) and not respect to ambient pressure or some other pressure. It is noted that atmospheric pressure is nominally $1\times10^5$ Pa (Pascal) in absolute mode. It is appreciated by a person of ordinary skill that the degree of vacuum may be pressures ranging from $10^5$-$10^{-10}$ Pa, but preferably $10^5$-$10^{-7}$ Pa, and more preferably $10^5$-$10^{-4}$ Pa. It is appreciated by a person of ordinary skill in the art that the vacuum may be produced by any conventional vacuum packaging equipment, and preferably vacuum skin packaging equipment.

As used herein, the phrase "surface-treatment" as applied to film layers of the present invention refers to any technique which alters the surface energy (or surface tension) of a film layer and may include techniques such as, but is not limited to, corona, flame, and plasma treatment, ozone, ultra-high frequency electrical discharge, UV or laser bombardment, chemical priming, and the like. The phrase "corona treatment" refers to, in general, the process wherein an electrical discharge generated by a high-voltage electric field passes through a polymer substrate. It is believed that the electrical discharge or "corona" may ionize the oxygen molecules surrounding the substrate which chemically interact with the surface atoms of the substrate thereby changing the surface energy of the polymer substrate.

As used herein, the phrases "surface tension" and "surface energy" are used interchangeably herein and refer to the affinity between molecules at the surface of a polymer film layer for one another. It is appreciated by a person of ordinary skill in the art that surface tension is a measure of surface energy of a polymer film substrate which involves determination of the interaction between the solid film substrate and a test liquid or "dyne liquid." Surface tension is expressed in units of force per unit of width, e.g., dynes per centimeter. Measuring surface energy of a polymer film substrate may also be known as a "dyne test." Typically, a dyne test involves applying a dyne liquid, e.g., a predetermined mixture of ethylene glycol monoethyl ether and formamide having a known surface tension, across a one square inch of a polymer surface. If the continuous film of liquid remains intact or fails to wet-out for two or more seconds, the next higher surface tension liquid is applied. If the liquid dissipates in less than two seconds, the next lower surface tension solutions are tried until an exact measurement is attained. The dyne test is based on ASTM D-2578-84 Test Method, which is incorporated herein by reference in its entirety.

As used herein, the term "adhesive" refers to a polymeric material serving a primary purpose or function of adhering two surfaces to one another. In the present invention, the adhesive may adhere one film layer surface to another film layer surface (presumably, across their entire surface areas). The adhesive may comprise any polymer, copolymer or blend of polymers having a polar group thereon, or any other polymer, homopolymer, copolymer or blend of polymers including modified and unmodified polymers, e.g., grafted copolymers, which provide sufficient interlayer adhesion to adjacent layers comprising otherwise non-adhering polymers. Adhesive compositions of the present invention may include, but are not limited to, modified and unmodified polyolefins, preferably modified polyethylene and an unmodified polyacrylate resin, preferably selected from the group consisting of ethylene/vinyl acrylate copolymer, ethylene/ethyl acrylate copolymer, ethylene/butyl acrylate copolymer, or blends thereof.

As used herein, the phrase "oxygen barrier material" refers to any polymeric material which will control the oxygen permeability of the entire film. For perishable food packaging applications, the oxygen transmission rate (OTR) desirably should be minimized. The term "oxygen transmission rate" is defined herein as the amount of oxygen in cubic centimeters ($cm^3$) which will pass through 100 $in.^2$ of film in 24 hours at 0% R.H. and 23° C. (or $cm^3$/100 $in.^2$ more than 24 hours at 0% R.H. and 23° C.). The thickness (gauge) of the film has a direct relationship on the oxygen transmission rate. Oxygen barrier materials suitable for use in film structures of the present invention may have an OTR value of from about 0-2.0 $cm^3$/100 $in.^2$ more than 24 hours at 23° C. and 0% R.H. Oxygen transmission may be measured according to ASTM D-3985-81 Test Method, which is incorporated herein by reference in its entirety.

As used herein, the term "cross-linking" refers to the chemical reaction which results in the formation of bonds between polymer chains, such as, but not limited to, carbon-carbon bonds. Cross-linking may be accomplished by use of a chemical agent or combination thereof which may include, but is not limited to, for example, peroxide, silanes and the like, and ionizing radiation, which may include, but is not limited to, high energy electrons, gamma-rays, beta particles and ultraviolet radiation. The irradiation source can be any electron beam generator operating in a range of about 150-6000 kilovolts (6 megavolts) with a power output capable of supplying the desired dosage. The voltage can be adjusted to appropriate levels which may be, for example, 1-6 million volts or higher or lower. Many apparatus for irradiating films are known to those skilled in the art. In general, the most preferred amount of radiation is dependent upon the film structure and its total thickness. One method for determining the degree of "cross-linking" or the amount of radiation absorbed by a material is to measure the "gel content." As used herein, the term "gel content" refers to the relative extent of cross-linking within a polymeric material. Gel content is expressed as a relative percent (by weight) of the polymer having formed insoluble carbon-carbon bonds between polymers and may be determined by ASTM D-2765-01 Test Method, which is incorporated herein by reference in its entirety.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

FIG. 1 is a schematic, cross-section diagram of one embodiment of a vacuum skin package 1 according to the present invention having a thermoplastic film 2 and a polyester substrate 3. As depicted, thermoplastic film 2 may cover product 4 and may be sealed around the perimeter of polyester substrate 3 in a manner to assume the shape of the product 4 and thus, film 2 may become a "skin" around product 4. Thermoplastic film 2 may comprise at least a first polymer layer 5, having a first surface 5*a* and an opposing second surface 5*b*. Preferably first surface 5*a* may have a surface tension of between 36-60 dynes/cm, and more preferably 40-56 dynes/cm such that a peelable seal 6 may be provided between first polymer layer 5 and polyester substrate 3 by a vacuum or pressure of less than $1\times10^5$ Pa applied therebetween. Preferably peelable seal 6 may have a seal strength of between 0.5-6 lb./in. (0.09-1.09 kg/cm) as measured in accordance with ASTM F-904-98 Test Method. It is recognized that first polymer layer 5 is an exterior film of film 1 and may comprise any ethylene/unsaturated ester copolymer and may be free of both polybutylene and an ionomer resin. Preferably first polymer layer 5 may comprise a material selected from the group consisting of ethylene/methyl acrylate copolymer, ethylene/methyl methacrylate copolymer, ethylene/ethyl acrylate copolymer, ethylene/ethyl methacrylate copolymer, ethylene/butyl acrylate copolymer, ethylene/2-ethylhexyl methacrylate copolymer, ethylene/vinyl acetate copolymer, and blends thereof, and more preferably an ethylene/vinyl acetate copolymer of blends thereof. Polyester substrate 3 may include any polyester or blend thereof, and preferably a polyester selected from the group consisting of polyethylene terephthalate (PET), crystalline polyethylene terephthalate (CPET), amorphous polyethylene terephthalate (APET), and blends thereof.

Figure 2:
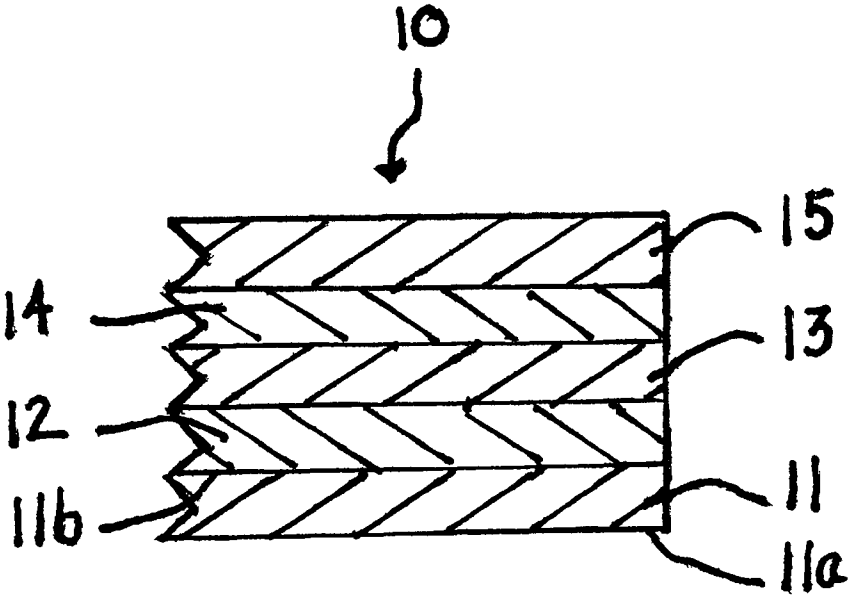
FIG. 2 is a partial schematic, cross-sectional view of one thermoplastic film suitable for use in the vacuum skin packages according to the present invention having at least a polymeric first layer, a polymeric second layer, a polymeric third layer, a polymeric fourth layer and a polymeric fifth layer.

FIG. 2 is a partial schematic, cross-section diagram of as example of another thermoplastic film suitable for use in vacuum skin packages according to the present invention. In this embodiment, thermoplastic film 10 is depicted having a first polymer layer 11 having a first surface 11*a* and an opposing second surface 11*b*, a second polymer layer 12, a third polymer layer 13, a fourth polymer layer 14, and a fifth polymer layer 15. It is recognized that polymeric layers 12, 13 and 14 are each an interior film layer in contrast to a first polymer layer 11 and a fifth polymer layer 15 which are each an exterior film layer. A first polymer layer 11, having a first surface 11*a* and an opposing second surface 11*b*, may have the same composition and surface tension properties as described above for first layer 5 of thermoplastic film 2 in FIG. 1. It is noted that a peelable seal (illustrated in FIGS. 1 and 3) may be formed by sealing first surface 11*a* of layer 11 to any polyester substrate (illustrated in FIGS. 1 and 3) under a vacuum. It is noted that, in this particular example, it is preferable that a second polymer layer 12 comprise an ionomer resin or blend thereof and adhere to a first polymer 11; a third polymer layer 13 comprises a material selected from the group consisting of a polyolefin resin, an ionomer resin, an oxygen barrier material or blends thereof; a fourth polymer layer 14 comprises a material selected from the group consisting of a polyolefin resin, an ionomer resin or blends thereof, and a fifth polymer layer 15 comprised of a polyolefin or blends thereof.

Figure 3:
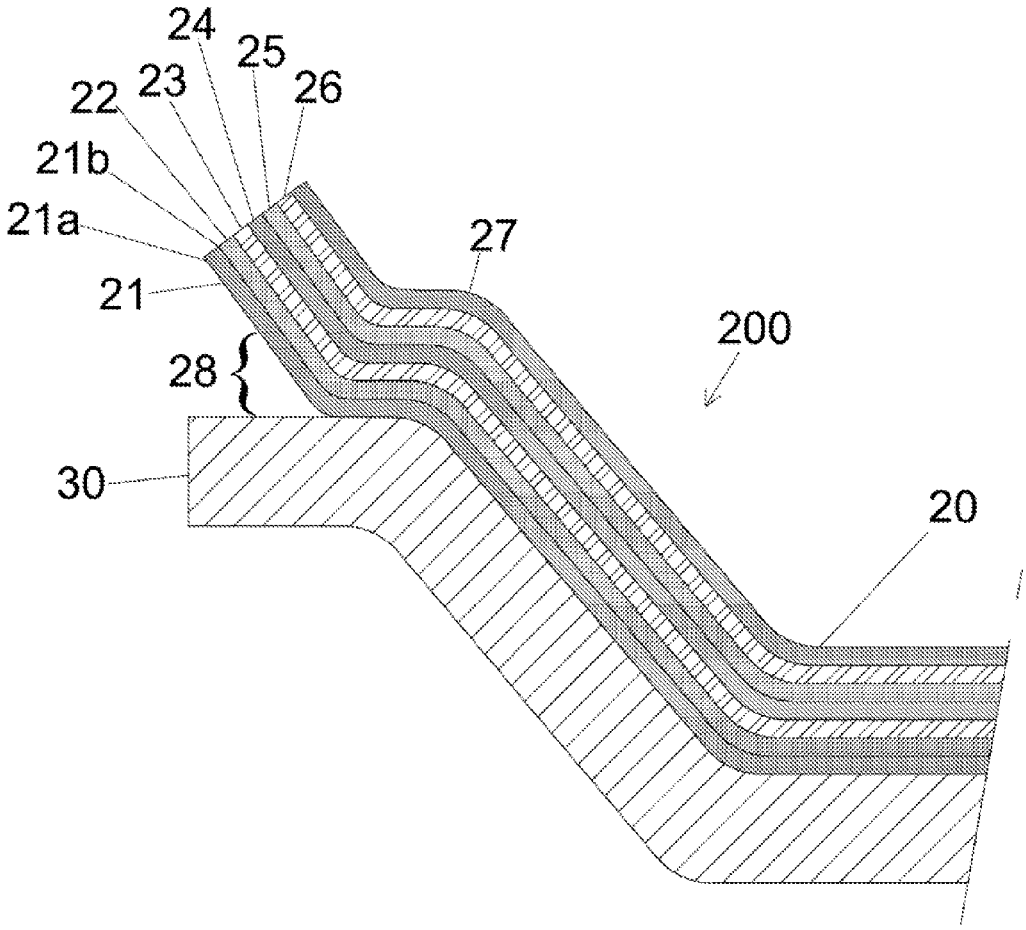
FIG. 3 is a partial schematic, cross-sectional view of one embodiment of the vacuum skin package according to the present invention having a seven-layer thermoplastic film and sealed to a polyester substrate, in a partially-opened state.

Now turning to FIG. 3, depicted is a partial schematic, cross-section diagram of one embodiment of a vacuum skin package according to the present invention. As depicted, vacuum skin package 200 is illustrated in a partially opened state. Vacuum skin package 200 includes a thermoplastic film 20 and a polyester substrate 30 (as described for polyester substrate 3 in FIG. 1). Thermoplastic film 20 was produced having an overall film thickness of about 4 mil and a first polymer layer 21, having a first surface 21*a* and an opposing second surface 21*b*, and having a second polymer layer 22, a third polymer layer 23, a fourth polymer layer 24, a fifth polymer layer 25, a sixth polymer layer 26, and a seventh polymer layer 27. First polymer layer 21 is comprised of an ethylene/vinyl acetate copolymer and is free of both polybutylene and an ionomer resin. Examples of commercially available ethylene/vinyl acetate copolymers include, but are not limited to, materials sold under the trademark DuPont™ Elvax® 3135X and 3135XZ, both of which have a 12% (wt.) vinyl acetate content, a density of 0.93 g/cm$^3$, a melt index of 0.35 g/10 minutes, a Vicat softening point of 82° C., a melting point of 95° C., and are produced by du Pont de Nemours and Company, Inc., Wilmington, Del., United States. Other examples of suitable ethylene/vinyl acetate copolymers include, but not limited to, materials sold under the trademarks Escorene™ Ultra UL 00012 which has a 12% (wt.) vinyl acetate content, a density of 0.936 g/cm$^3$, a melt index of 0.3 g/10 minutes, a Vicat softening point of 81° C., a melting point of 96° C., and Escorene™ Ultra LD 705.MJ which has a 13.3% (wt.) vinyl acetate content, a density of 0.935 g/cm$^3$, a melt index of 0.4 g/10 minutes, a Vicat softening point of 76° C., a melting point of 93° C., which are both produced by ExxonMobil Chemical Company, Inc., Houston, Tex., U.S.A. First surface 21*a* of first polymer layer 21 has a surface tension of between 40-56 dynes/cm as measured in accordance with ASTM D-2578-84 Test Method. As depicted, first polymer layer 21 was sealed to polyester substrate 30 under vacuum pressures of less than $1\times10^5$ Pa, peelable seal 28 was formed therebetween having a seal strength of between 0.5-6 lb./in. (0.09-1.08 kg/cm) as measured in accordance with ASTM F-904 Test Method. First polymer layer 21 had a thickness of about 12.9% of the total thickness of film 20. It is recognized that, due to the stronger bond strength which was formed between first polymer layer 21 and second polymer layer 22, film 20 ruptured preferentially between first polymer layer 21 and polyester substrate 30. As depicted, second polymer layer 22 adheres to both first and third polymer layers 21 and 23. Both second polymer layer 22 and sixth polymer layer 26 includes an ionomer resin having a melt index of 1.5 g/10 minutes, a Vicat softening point of 73° C., a melting point of 97° C., which is sold under the trademark Surlyng 1650 and is available from du Pont de Nemours and Company, Inc., Wilmington, Del., United States. The thickness of second and sixth polymer layers 22 and 26 are each about 22.3% of the total thickness of film 20. Third polymer layer 23 and fifth polymer layers 25 both comprise an anhydride-modified linear low-density polyethylene having a melt index of 2.7 g/10 minutes, a Vicat softening point of 103° C., a melting point of 115° C. and a density of 0.91 g/cm$^3$, which is sold under the trademark Bynel® 41E710 and is also available from du Pont de Nemours and Company, Inc., Wilmington, Del., United States. It is noted that third layer 23 is in contact with both second and fifth polymer layers 22 and 25. The thickness of the third and fifth polymer layers 23 and 25 are each about 7.0% of the total thickness of film 20. The fifth polymer layer 25 is in contact with both the fourth and sixth polymer layers 24 and 26. Fourth polymer layer 24 includes an oxygen barrier material of ethylene/vinyl alcohol copolymer having an ethylene content of 38% (wt.), a density of 1.17 g/cm$^3$, a melt index of 3.2 g/10 minutes, a melting point of 173° C., a glass transition temperature of 58° C., and sold under the trademark Soarnol® ET3803 which is available from Soarus L.L.C., Arlington Heights, Ill., United States. Another suitable ethylene/vinyl alcohol copolymer having an ethylene content of 38% (wt.), includes, but is not limited to, a material having a density of 1.17 g/cm$^3$, a melting point of 172° C., a glass transition temperature of 53° C. which is available under the trademark Eval™ H171 and may be purchased from Kuraray Company Ltd., Tokyo, Japan. The thickness of fourth polymer layer 24 was about 11.9% of the total thickness of film 20. Seventh polymer layer 27 is an exterior film layer which comprises a low-density polyethylene having a density of 0.920 g/cm$^3$, a melt index of 1.9 g/10 minutes, a melting point of 110° C., which is available as LD 134.09 from ExxonMobil Chemical Company, Houston, Tex., United States. An example of another commercially available low-density polyethylene suitable for use in the present invention includes, but is not limited to, a polyethylene having a density of 0.923 g/cm$^3$, a melt index of 2.6 g/10 minutes, a melting point of 113° C., a Vicat softening point of 97° C., which is sold as Dow™ Polyethylene 608A from The Dow Chemical Company, Midland, Mich., United States.

Unless otherwise noted, the polymer resins utilized in the present invention are generally commercially available in pellet form and, as generally recognized in the art, may be melt blended or mechanically mixed by well-known methods using commercially available equipment including tumblers, mixers or blenders. Also, if desired, well-known additives such as processing aids, slip agents, anti-blocking agents and pigments, and mixtures thereof may be incorporated into the polymer layers, by blending prior to extrusion. The resins and any additives may be introduced to an extruder where the resins are melt-plastified by heating and then transferred to an extrusion (or coextrusion) die for formation into a tube. Extruder and die temperatures will generally depend upon the particular resin or resin containing mixtures being processed and suitable temperature ranges for commercially available resins are generally known in the art, or are provided in technical bulletins made available by resin manufacturers. Processing temperatures may vary depending upon other processing parameters chosen.

The film structures of the present invention may be produced using simple blown film processes which are described, for example, in *The Encyclopedia of Chemical Technology,* Kirk-Othmer, Third Edition, John Wiley & Sons, New York, 1981, Vol. 16, pp. 416-417 and Vol. 18, pp. 191-192, the disclosures of which are incorporated herein by reference. Generally, the simple blown film process may include an apparatus having a multi-manifold circular die head through which the film layers are forced and formed into a cylindrical multilayer film bubble. The bubble may be quenched, e.g., via cooled water bath, solid surface and/or air, and then ultimately collapsed and formed into a multilayer film. It is appreciated by a person of ordinary skill in the art that cast extrusion techniques may also be used to fabricate the film structures of the present invention.

Unless otherwise noted, the physical properties and performance characteristics reported herein were measured by test procedures similar to the following methods. The following ASTM test procedures are incorporated herein by reference in their entireties.

| | |
|---|---|
| Density | ASTM D-1505 |
| Gel Content | ASTM D 2765-01 |
| Glass Transition Temperature | ASTM D-3417 |
| Melt Index | ASTM D-1238 |
| Melting Point | ASTM D-3417 |
| Seal Strength | ASTM F-904 |
| Vicat Softening Point | ASTM D-1525 |

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A vacuum skin package comprising:

(a) a thermoplastic film;

(b) a polyester substrate;

(c) a product enclosed between said thermoplastic film and said polyester substrate;

wherein said thermoplastic film comprises at least a first polymer layer having a first surface and an opposing second surface, wherein said first surface is surface treated to produce a surface tension thereupon of between 36-60 dynes/cm as measured in accordance with ASTM D-2578-84 Test Method, wherein said first layer is an exterior film layer consisting essentially of an ethylene/unsaturated ester copolymer and is free of both polybutylene and ionomer resin; and (d) a peelable seal formed between said first surface of said first layer of said thermoplastic film and said polyester substrate by pressure of less than $1\times10^5$ Pa applied therebetween, wherein said peelable seal has a seal strength of between 0.5-6 lb./in, (0.09-1.08 kg/cm) as measured in accordance with ASTM F-904 Test Method;

wherein said thermoplastic film is peelably sealed to the entire surface area of said polyester substrate expect for the portion of the film covering the product so that said thermoplastic film remains in close contact with said product surfaces after sealing.

2. A vacuum skin package according to claim 1, wherein said thermoplastic film is a coextruded thermoplastic film formed by either cast or blown film coextrusion.

3. A vacuum skin package according to claim 1, wherein said thermoplastic film has an unrestrained linear thermal shrinkage in both the machine and transverse directions of less than 15% as measured in accordance with ASTM D-2732 Test Method.

4. A vacuum skin package according to claim 1, wherein said thermoplastic film further comprises a second polymer layer of an ionomer resin or a blend thereof, wherein said second layer adheres to said first layer.

5. A vacuum skin package according to claim 4, wherein said thermoplastic film is a cross-linked thermoplastic film such that at least one polymer layer of said cross-linked thermoplastic film has a gel content of not less than 5% as measured in accordance with ASTM D 2765-01 Test Method.

6. A vacuum skin package according to claim 4, wherein said thermoplastic film further comprises a third polymer layer of an adhesive material, wherein said third layer adheres to said second layer and is an interior film layer.

7. A vacuum skin package according to claim 6, wherein said thermoplastic film further comprises a fourth polymer layer of a material selected from the group consisting of polyolefin resin, ionomer resin and oxygen barrier material, wherein said fourth layer adheres to said third layer.

8. A vacuum skin package according to claim 7, wherein said thermoplastic film further comprises a fifth polymer layer of an adhesive material, wherein said fifth layer adheres to said fourth layer and is an interior film layer.

9. A vacuum skin package according to claim 8, wherein said thermoplastic film further comprises a sixth polymer layer of a material selected from the group consisting of polyolefin resin, ionomer resin and blends thereof.

10. A vacuum skin package according to claim 9, wherein said thermoplastic film further comprises a seventh polymer layer of a polyolefin resin or blend thereof, wherein said seventh layer is an exterior film layer.

11. A vacuum skin package according to claim 1, wherein said first surface of said first layer of said thermoplastic film has a surface tension of between 40-56 dynes/cm as measured in accordance with ASTM D-2578-84 Test Method.

12. A vacuum skin package according to claim 7, wherein said oxygen barrier material is a polymeric material such that said thermoplastic film has an oxygen transmission rate of between 0-2.0 cc/100 in.$^2$/24 hours at 23° C. and 0% R.H. as measured in accordance with ASTM D-3985-02 Test Method.

13. A vacuum skin package according to claim 7, wherein said oxygen barrier material is selected from the group consisting of homopolymers or copolymers of ethylene/vinyl alcohol, vinylidene chloride copolymers, and blends thereof.

14. A vacuum skin package according to claim 1, wherein said polyester substrate comprises a material selected from the group consisting of polyethylene terephthalate (PET), crystalline polyethylene terephthalate (CPET), amorphous polyethylene terephthalate (APET), and blends thereof.

15. A vacuum skin package according to claim 1, wherein said ethylene/unsaturated ester copolymer comprises a material selected from the group consisting of ethylene/methyl acrylate copolymer, ethylene/methyl methacrylate copolymer, ethylene/ethyl acrylate copolymer, ethylene/ethyl methacrylate copolymer, ethylene/butyl acrylate copolymer, ethylene/2-ethylhexyl methacrylate copolymer, ethylene/vinyl acetate copolymer, and blends thereof.

16. A vacuum skin package comprising:

(a) a thermoplastic film, (b) a polyester substrate;

(c) a product enclosed between said thermoplastic film and said polyester substrate;

wherein said thermoplastic film comprises at least a first polymer layer, a second polymer layer, a third polymer layer, a fourth polymer layer and a fifth polymer layer;

wherein said first layer has a first surface and an opposing second surface, wherein said first surface is surface treated to produce a surface tension thereupon of between 40-56 dynes/cm as measured in accordance with ASTM D-2578-84 Test Method and consisting essentially of a material selected from the group consisting of ethylene/methyl acrylate copolymer, ethylene/methyl methacrylate copolymer, ethylene/ethyl acrylate copolymer, ethylene/ethyl methacrylate copolymer, ethylene/butyl acrylate copolymer, ethylene/2-ethylhexyl methacrylate copolymer, ethylene/vinyl acetate copolymer, and blends thereof, wherein said first layer is an exterior film layer and is free of both polybutylene and ionomer resin;

wherein said second layer comprises an ionomer resin or a blend thereof, wherein said second layer adheres to said first layer and is an interior film layer;

wherein said third layer comprises a material selected from the group consisting of polyolefin resin, ionomer resin, oxygen barrier material and a blend thereof, wherein said third layer is an interior film layer;

wherein said fourth layer comprises a material selected from the group consisting of polyolefin resin, an ionomer resin or blends thereof, wherein said fourth layer is an interior film layer;

wherein said fifth layer comprising a polyolefin resin or a blend thereof, wherein said fifth layer is an exterior film layer; and (d) a peelable seal formed between said first surface of said first polymer layer of said thermoplastic film and said polyester substrate by pressure of less than $1\times10^5$ Pa applied therebetween, wherein said peelable seal has a seal strength of between 0.5-6 lb./in. (0.09-1.08 kg/cm) as measured in accordance with ASTM F-904 Test Method;

wherein said thermoplastic film is peelably sealed to the entire surface area of said polyester substrate expect for the portion of the film covering the product so that said thermoplastic film remains in close contact with said product surfaces after sealing.

17. A vacuum skin package according to claim 16, wherein said thermoplastic film is a thermoplastic coextruded film formed by either cast or blown film coextrusion.

18. A vacuum skin package according to claim 16, wherein said thermoplastic film further comprises a sixth polymer layer and a seventh polymer layer, wherein said sixth and seventh layers each comprise an adhesive material.

19. A vacuum skin package according to claim 16, wherein said thermoplastic film has an unrestrained linear thermal shrinkage in both the machine and transverse directions of less than 15% as measured in accordance with ASTM D-2732 Test Method.

20. A vacuum skin package according to claim 16, wherein said thermoplastic film is a cross-linked thermoplastic film such that at least one layer of said cross-linked thermoplastic film has a gel content of not less than 5% as measured in accordance with ASTM D 2765-01 Test Method.

21. A vacuum skin package according to claim 16, wherein said first surface of said first layer of said thermoplastic film has a surface tension of between 40-56 dynes/cm as measured in accordance with ASTM D-2578-84 Test Method.

22. A vacuum skin package according to claim 16, wherein said oxygen barrier material is a polymeric material such that said thermoplastic film has an oxygen transmission rate of between 0-2.0 cc/100 in.$^2$/24 hours at 23° C. and 0% R.H. as measured in accordance with ASTM 0-3985-02 Test Method.

23. A vacuum skin package according to claim 16, wherein said oxygen barrier material comprises a material selected from the group consisting of homopolymers or copolymers of ethylene/vinyl alcohol, vinylidene chloride copolymer and blends thereof.

24. A vacuum skin package according to claim 16, wherein said polyester substrate comprises a material selected from the group consisting of polyethylene terephthalate (PET), crystalline polyethylene terephthalate (CPET), amorphous polyethylene terephthalate (APET), and blends thereof.

25. A vacuum skin package according to claim 16, wherein said sixth layer adheres to both said second and third layers, wherein said seventh layer adheres to both said third and fourth layers.

26. A vacuum skin package comprising:

(a) a thermoplastic film;

(b) a polyester substrate;

(c) a product enclosed between said thermoplastic film and said polyester substrate;

wherein said thermoplastic film comprises at least a first polymer layer, a second polymer layer, a third polymer layer, a fourth polymer layer, a fifth polymer layer, a sixth polymer layer and a seventh polymer layer;

wherein said first layer has a first surface and an opposing second surface, wherein said first surface is surface treated to produce a surface tension thereupon of between 40-56 dynes/cm as measured in accordance with ASTM D-2578-84 Test Method and consists essentially of ethylene/vinyl acetate copolymer or a blend thereof, wherein said first layer is an exterior film layer and is free of both polybutylene and ionomer resin;

wherein said second layer comprises an ionomer resin or a blend thereof, wherein said second layer adheres to both said first and third layers;

wherein said third layer comprises an adhesive material and adheres to both said second and fourth layers;

wherein said fourth layer comprises either a material selected from the group consisting of polyolefin resin, ionomer resin, and a blend thereof, or an oxygen barrier material, wherein said oxygen barrier material is a polymeric material such that said thermoplastic film has an oxygen transmission rate of between 0-2.0 cc/100 in.$^2$/24 hours at 23° C. and 0% R.H. as measured in accordance with ASTM D-3985-02 Test Method, wherein said fourth layer is an interior film layer;

wherein said fifth layer comprises an adhesive material and adheres to both said fourth and sixth layers;

wherein said sixth layer comprises a material selected from the group consisting of polyolefin resin, ionomer resin, and blends thereof;

wherein said seventh layer comprises a polyolefin resin or blend thereof, wherein said seventh layer adheres to said sixth layer and is an exterior film layer; and (d) a peelable seal formed between said first surface of said first polymer layer of said thermoplastic film and said polyester substrate by pressure of less than $1\times10^5$ Pa applied therebetween, wherein said peelable seal has a seal strength of between 0.5-6 lb./in. (0.09-1.08 Kg/cm) as measured in accordance with ASTM F-904 Test Method;

wherein said thermoplastic film is peelably sealed to the entire surface area of said polyester substrate expect for the portion of the film covering the product so that said thermoplastic film remains in close contact with said product surfaces after sealing.

27. A vacuum skin package according to claim 26, wherein said thermoplastic film is a coextruded thermoplastic film formed by either cast or blown film coextrusion.

28. A vacuum skin package according to claim 26, wherein said thermoplastic film has an unrestrained linear thermal shrinkage in both the machine and transverse directions of less than 15% as measured in accordance with ASTM D-2732 Test Method.

29. A vacuum skin package according to claim 26, wherein said thermoplastic film is a cross-linked thermoplastic film such that at least one polymer layer of said cross-linked thermoplastic film has a gel content of not less than 5% as measured in accordance with ASTM D 2765-01 Test Method.

30. A vacuum skin package according to claim 26, wherein said polyester substrate comprises a material selected from the group consisting of polyethylene terephthalate (PET), crystalline polyethylene terephthalate (CPET), amorphous polyethylene terephthalate (APET), and blends thereof.

31. A vacuum skin package according to claim 26, wherein said oxygen barrier material comprises a material selected from the group consisting of homopolymers or copolymers of ethylene/vinyl alcohol, vinylidene chloride copolymers, and blends thereof.

32. A vacuum skin packaging kit comprising:

(a) a thermoplastic film;

(b) a polyester substrate;

(c) a product enclosed between said thermoplastic film and said polyester substrate;

wherein said thermoplastic film comprises at least a first polymer layer, a second polymer layer, a third polymer layer, a fourth polymer layer, a fifth polymer layer, a sixth polymer layer and a seventh polymer layer;

wherein said first layer has a first surface and an opposing second surface, wherein said first surface is surface treated to produce a surface tension thereupon of between 40-56 dynes/cm as measured in accordance with ASTM D-2578-84 Test Method and consists essentially of ethylene/vinyl acetate copolymer or a blend thereof, wherein said first layer is an exterior film layer and is free of both polybutylene and ionomer resin;

wherein said second layer comprises an ionomer resin or a blend thereof, wherein said second layer adheres to both said first and third layers;

wherein said third layer comprises an adhesive material and adheres to both said second and fourth layers;

wherein said fourth layer comprises either a material selected from the group consisting of polyolefin resin, ionomer resin, and a blend thereof, or an oxygen barrier material, wherein said oxygen barrier material is a polymeric material such that said thermoplastic film has an oxygen transmission rate of between 0-2.0 cc/100 in.$^2$/24 hours at 23° C. and 0% R.H. as measured in accordance with ASTM D-3985-02 Test Method, wherein said fourth layer is an interior film layer;

wherein said fifth layer comprises an adhesive material and adheres to both said fourth and sixth layers;

wherein said sixth layer comprises a material selected from the group consisting of polyolefin resin, ionomer resin, and blends thereof;

wherein said seventh layer comprises a polyolefin resin or blend thereof, wherein said seventh layer adheres to said sixth layer and is an exterior film layer; and (d) a peelable seal formed between said first surface of said first polymer layer of said thermoplastic film and said polyester substrate by pressure of less than $1\times10^5$ Pa applied therebetween, wherein said peelabe seal has a seal strength of between 0.5-6 lb./in. (0.09-1.08 Kg/cm) as measured in accordance with ASTM F-904 Test Method;

wherein said thermoplastic film is peelably sealed to the entire surface area of said polyester substrate expect for the portion of the film covering the product so that said thermoplastic film remains in close contact with said product surfaces after sealing.

33. A vacuum skin packaging kit according to claim 32, wherein said thermoplastic film is a coextruded thermoplastic film formed by either cast or blown film coextrusion.

34. A vacuum skin packaging kit according to claim 32, wherein said thermoplastic film has an unrestrained linear thermal shrinkage in both the machine and transverse directions of less than 15% as measured in accordance with ASTM D-2732 Test Method.

35. A vacuum skin packaging kit according to claim 32, wherein said thermoplastic film is a cross-linked thermoplastic film such that at least one polymer layer of said cross-linked thermoplastic film has a gel content of not less than 5% as measured in accordance with ASTM D 2765-01 Test Method.

36. A vacuum skin packaging kit according to claim 32, wherein said polyester substrate comprises a material selected from the group consisting of polyethylene terephthalate (PET), crystalline polyethylene terephthalate (CPET), amorphous polyethylene terephthalate (APET), and blends thereof.

37. A vacuum skin packaging kit according to claim 32, wherein said oxygen barrier material comprises a material selected from the group consisting of homopolymers or copolymers of ethylene/vinyl alcohol, vinylidene chloride copolymers, and blends thereof.

* * * * *

UNITED STATES PATENT AND TRADEMARK OFFICE

CERTIFICATE OF CORRECTION

PATENT NO. : 8,597,746 B2
APPLICATION NO. : 11/141144
DATED : December 3, 2013
INVENTOR(S) : Otacilio T. Berbert It is certified that error appears in the above-identified patent and that said Letters Patent is hereby corrected as shown below:

In The Specification

In column 6, lines 1-2, delete "moeities." and insert -- moieties. --, therefor.

In column 6, line 46, delete "(10)," and insert -- (I0), --, therefor.

In column 10, line 7, delete "thereof," and insert -- thereof; --, therefor.

In column 10, line 59, delete "Surlyng" and insert -- Surlyn® --, therefor.

In The Claims

In column 12, line 46, in claim 1, delete "lb./in," and insert -- lb./in. --, therefor.

In column 13, line 52, in claim 16, delete "film," and insert -- film; --, therefor.

In column 14, line 57, in claim 22, delete "ASTM 0-3985-02" and insert -- ASTM D-3985-02 --, therefor.

In column 14, line 61, in claim 23, delete "copolymer" and insert -- copolymers. --, therefor.

In column 16, line 56, in claim 32, delete "peelabe" and insert -- peelable --, therefor.

Signed and Sealed this
Eleventh Day of August, 2015

Michelle K. Lee

Michelle K. Lee
*Director of the United States Patent and Trademark Office*